US006851231B2

(12) United States Patent
Tadros et al.

(10) Patent No.: US 6,851,231 B2
(45) Date of Patent: Feb. 8, 2005

(54) PRECAST POST-TENSIONED SEGMENTAL POLE SYSTEM

(76) Inventors: Maher K. Tadros, 2310 S. 105th Ave., Omaha, NE (US) 68124; E. Terence Foster, 1014 N. 67th Cir., Omaha, NE (US) 68132; Sherif A. Yehia, 10525 Pratt Plz., Omaha, NE (US) 68134; Audra L. Hansen, 365 Hopper St., Elkhorn, NE (US) 68022

( * ) Notice: Subject to any disclaimer, the term of this patent is extended or adjusted under 35 U.S.C. 154(b) by 25 days.

(21) Appl. No.: 10/184,349

(22) Filed: Jun. 27, 2002

(65) Prior Publication Data

US 2003/0000165 A1 Jan. 2, 2003

Related U.S. Application Data

(60) Provisional application No. 60/301,189, filed on Jun. 27, 2001.

(51) Int. Cl.[7] ..... E04C 3/10

(52) U.S. Cl. ..... 52/223.4; 52/223.14; 52/726.3; 52/223.5

(58) Field of Search ..... 52/223.4, 223.5, 52/223.14, 726.3, 726.4

(56) References Cited

PUBLICATIONS

Erickson Air–Crane, published in 2001.

Spun Concrete Distribution Poles—An Alternative by Fouad H. Fouad, Ph.D. et al., published in Transmission & Distribution, dated Apr. 1992, pp. 52–58.

HYPERCON Partnership for High–Performance Concrete Technology, Building and Fire Research Laboratory Program, dated Aug. 15, 2001, pp. 1–10.

Prestressed Concrete Poles: State–of–the–Art by Thomas E. Rodgers, Jr., published in PCI Journal, dated Sep.–Oct., 1984, pp. 52–103.

Behavior and Design of Static Cast Prestressed Concrete Distribution Poles by Barry T. Rosson, Ph.D., P.E. et al, published in PCI Journal, dated Sep.–Oct., 1996, pp. 94–107.

Guide for the Design and Use of Concrete Poles, by the Concrete Pole Task Committee, Tadros Associates, LLC, undated, pp. 1–49.

Performance of Spun Prestressed Concrete Poles During Hurricane Andrew by Fouad H. Fouad, Ph.D., P.E. et al., published in PCI Journal, dated Mar.–Apr., 1994, pp. 102–110.

Improving the Durability and Performance of Spun–Cast Concrete Poles by Walter H. Dilger, Ph.D., P. Eng., published in PCI Journal, dated Mar.–Apr., 1996, pp. 68–89.

*Primary Examiner*—Carl D. Friedman
*Assistant Examiner*—Basil Katcheves
(74) *Attorney, Agent, or Firm*—Shook, Hardy & Bacon L.L.P.

(57) ABSTRACT

A precast post-tensioned segmental pole system capable of supporting a load is provided. The pole system includes a plurality of pole segments that use connectors and strands to anchor them together. The strands extend within a cavity formed in the pole segments and are external to the wall structure of the pole segments. The strands may be coupled between both of the pole segments, or be anchored to a connector. The connector includes an upper piece that is coupled to one pole segment, and a lower piece that is coupled to the other pole segment. Upper and lower pieces interlock with each other to join the pole segments to one another. The strands are placed in tension so that pole system is capable of withstanding forces imposed by the load.

11 Claims, 4 Drawing Sheets

PRECAST POST-TENSIONED SEGMENTAL POLE SYSTEM

CROSS-REFERENCE TO RELATED APPLICATIONS

This application claims the benefit of U.S. Provisional Application No. 60/301,189, filed Jun. 27, 2001.

STATEMENT REGARDING FEDERALLY SPONSORED RESEARCH OR DEVELOPMENT

Not Applicable.

BACKGROUND OF THE INVENTION

The present invention relates to a post-tensioned pole system. In particular, the present invention relates to a post-tensioned pole system includes one or more precast segments which are coupled to one another by a connector and post-tensioned through the use of at least one strand that is external to the wall thickness of the pole segments.

It is well known that poles are used in a wide variety of applications including electrical transmission and distribution environments, lighting, telecommunications and as supports for wind energy turbines. When used in these environments, the poles are subjected to forces from the wind, water and structural loads such as the weight of wire transmission lines or a wind turbine. These forces create a moment or torque that the pole must resist in order to remain in an upright position. In resisting these forces, the pole has a tendency to flex thereby putting the bottom portion of the pole in compression and the top portion of the pole in tension.

In the past, the poles have been formed of various materials such as steel, wood, concrete, masonry materials and any combination thereof. The use of concrete to form the poles is relatively common due to its availability. However, the use of concrete to form the poles suffers from a number of drawbacks. For instance, while concrete is capable of withstanding a substantial amount of compression force, its ability to resist tension is considerably low. Therefore, different techniques have been established in an effort to enhance the concretes ability to withstand the tension forces imposed on the pole.

One technique used to enhance the ability of the concrete to withstand tension forces is pre-tensioning. Pre-tensioning the concrete has been accomplished by embedding strands within the concrete walls of the concrete using a spun or static cast technique. In the static cast method, the strands are arranged within the form prior to pouring the concrete. Both ends of each strand are jacked to place the strands in tension. The concrete is then placed into the form embedding the strands therein. The strands are cut after the concrete has gained adequate strength, releasing the force to the concrete. The tension in the strands places the concrete pole into compression thereby allowing it to withstand a greater amount of tension force. The spun cast technique is similar to the static method in that the strands are placed in the form prior to the addition of the concrete. However, instead of placing the concrete into a static form, the concrete is poured into a machine that spins the concrete forcing the concrete to the outer walls of the form and embedding the strands within the wall of the structure.

The aforementioned pre-tensioning techniques also suffer from a number of deficiencies. One problem with the spun cast method is that the concrete aggregate separates due to centrifugal force thereby making concrete weak and susceptible to cracking due to unequal distribution of aggregate. In addition, the equipment used to spin the concrete is expensive. In addition, both of the aforementioned methods of pre-tensioning concrete poles are problematic in that it takes a considerable amount of time to properly position the strands in the form prior to pouring the concrete.

Additionally, there other problems associated with current concrete pole structures. For example, the concrete structures that are used in these environments are typically unitary structures that extend to a height of about 80–90 feet. This is problematic because certain power transmission line applications may require the poles to extend to greater heights. Additionally, given the fact that poles are a unitary structure, it is very difficult to transport the pole structures from an off-site location to the construction site. Once the poles arrive at the site, they require large cranes and heavy machinery to lift them into position due to the weight and length of the pole.

Accordingly, there remains a need for a segmental post-tensioned pole system that increases maximum height of pole while reducing the difficulty in transporting the pole from off-site location to the construction site. In addition, there is also a need to simplify the installation and manufacture of the pole. The present invention fills these needs as well as various other needs.

BRIEF SUMMARY OF THE INVENTION

In order to overcome the above-stated problems and limitations, and to achieve the noted objects, there is provided a precast post-tensioned segmental pole system that is capable of supporting a load and withstanding other external forces.

In general, the pole system includes several pole segments with similar connectors anchoring them together. For example, the first and second pole segments each have top and bottom ends with a cavity formed therein. The connector is adapted to couple the top end of the first pole segment with the bottom end of the second pole segment. The connector includes upper and lower pieces. The upper piece includes a channel band coupled to the second pole segment and having an inner edge. The connector further includes a stiffener being disposed within the channel band. The lower piece includes a base plate coupled to the first pole segment and a cover plate coupled to the base plate and having an outer edge that is adapted to interlock with an inner edge of the upper piece. The strands are placed in tension and can either continue through or be anchored at any of the segment connectors.

Additionally, the pole system may also include an anchor that couples the anchored strand to the connector. The anchor may include a cylinder, a clasping mechanism slidably received within the cylinder, a pipe coupled to the cylinder and a spring mounted within the pipe. The spring retains the clasping mechanism within the cylinder when the strand is coupled when the clasping mechanism is releasably coupled to the anchored strand.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views.

DETAILED DESCRIPTION OF THE INVENTION

Figure 1:
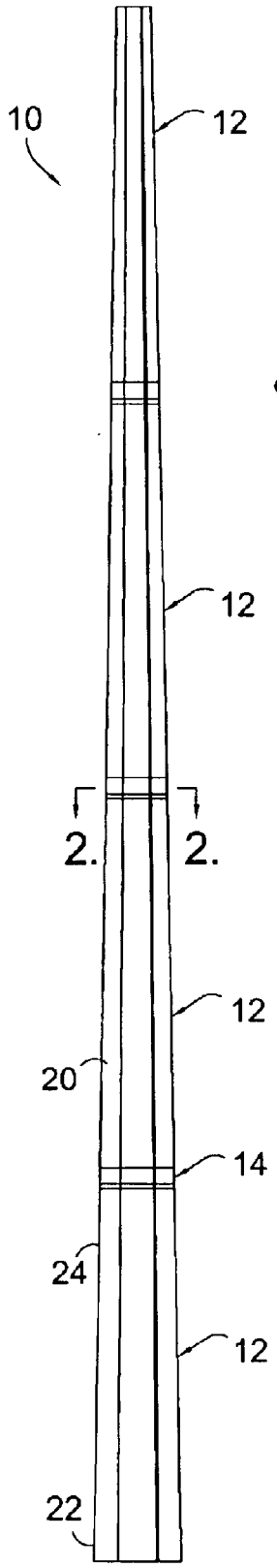
FIG. 1 is an elevational view of a post-tensioned segmental pole system according to the present invention.
Figure 3:
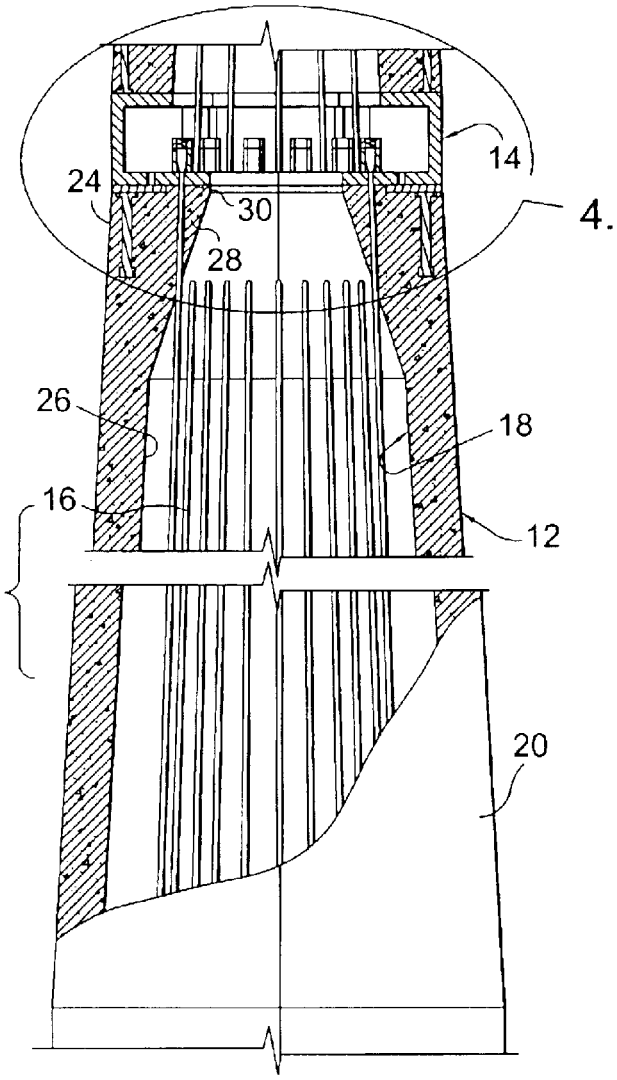
FIG. 3 is a cross-sectional view taken along line 3—3 of FIG. 2 showing a plurality of strands extending within the cavity of the pole segment.

Referring now to the drawings in detail, and initially to FIG. 1, numeral 10 generally designates a post-tensioned segmental pole system constructed in accordance with a first preferred embodiment of the present invention. Pole system 10 may include one or more pole segments 12 coupled to one another by a connector 14 to form a monopole structure. As best seen in FIG. 3, pole system 10 also includes a plurality of strands or tendons 16 that extend through a hollow interior cavity 18, and which are external to pole segment 12. Strands 16 are placed under tension and coupled between pole segments 12.

Pole system 10 may be used to support a load such as a structural appurtenance, insulator anchor, antenna in various types of service environments including, but not limited, to electrical transmission and distribution, lighting, communications and wind power generation. In addition, pole system 10 may also withstand external forces such as, but not limited to, wind, water and the like. It will be understood that a number of pole systems may be used in conjunction to form a multi-pole system to increase the height capability of pole system 10. For instance, a number of pole systems may be arranged in a tripod configuration to provide support for a single pole system that would extend upwardly from the apex of the tripod. This configuration would essentially double the overall height capabilities of the present invention.

As best seen in FIG. 1, pole system 10 may include one to four pole segments 12 that may form a monopole structure of up to 120 feet (36 meters). With additional reference to FIGS. 2 and 3, each pole segment 12 may be approximately 30 feet (9 meters) in length having a tapered hexagonal cross-section. It is desirable to use a pole segment 12 having a cross-section that has stiffness characteristics that are independent of lateral applied loads such as, but not limited to, wind or wave forces. Therefore, it is preferable to use a pole segment 12 having a radial symmetrical cross-section with a flat outer surface 20 so that appurtenances may be fastened to pole segment 12. Although a hexagonal cross-section is described and shown herein, it is within the scope of the present invention to use a pole segment 12 having cross-section in the shape of an octagon or any other radially symmetric cross-sectional shape.

Figure 4:
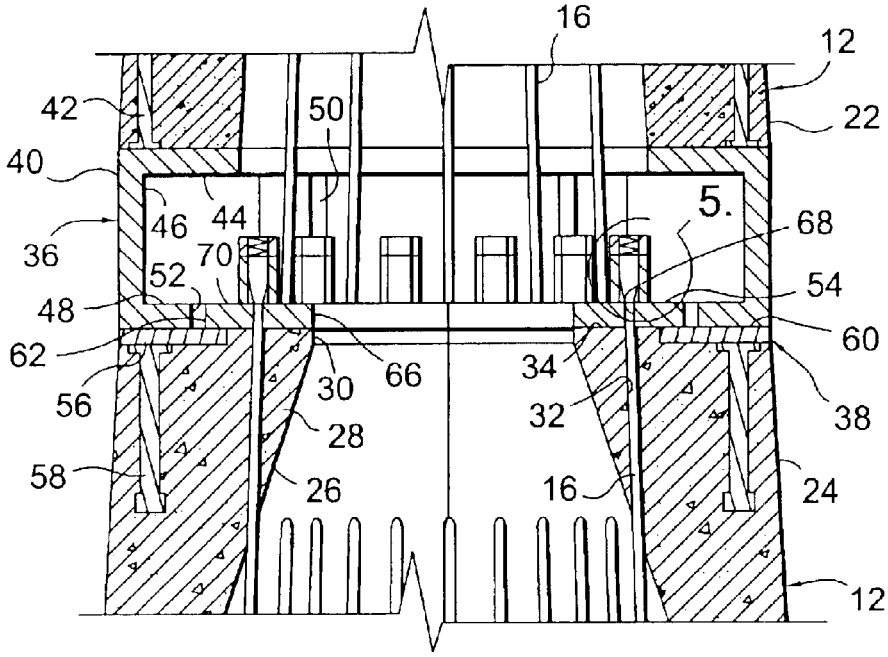
FIG. 4 is an enlarged view of the area encompassed by "4" in FIG. 3 showing the connector mounted between two pole segments.

As best seen in FIG. 1, outer surface 20 of pole segment may be tapered at the rate of 1 inch (25 mm) over a distance of 10 feet as pole segment 12 extends from a bottom portion 22 to a top portion 24. As best seen in FIGS. 3 and 4, an inner surface 26 of pole segment 12 also tapers inwardly at approximately the same rate as outer surface 20 and defines hollow interior cavity 18. Top portion 24 of inner surface 26 may include a thickened portion 28 where inner surface 26 tapers inwardly at a greater rate compared to bottom portion 22 of inner surface 26. Thickened portion 28 may begin at an intermediate portion of inner surface 26 and extend to a rim 30 at top portion 24. Further, a plurality of apertures 32 are formed in inner surface 26 and extend through thickened portion 28 to a top surface 34 of pole segment 12. Apertures 32 are hexagonally disposed within hollow interior cavity 18 and adapted to allow strands 16 to pass therethrough. The number of apertures 32 formed in segment 12 preferably corresponds with the number of strands 16 extending within cavity 18.

Pole segments 12 may be formed of various types of concrete including, but not limited to, high performance concrete (HPC) which is capable of higher than normal compressive strengths. High performance concrete utilizes fibers that are used to reinforce the concrete instead of using standard reinforced bars to enhance the concrete strength. The high performance concrete may have a minimum compressive strength of 8000 pounds per square inch, a RCP factor of 1000 coulombs, and a minimum freeze-thaw capacity for cold weather environments. However, pole system 10 may also utilize reinforcement bars or welded wire fabric within the walls of pole segments 12 to increase the strength of pole segment 12.

Figure 2:
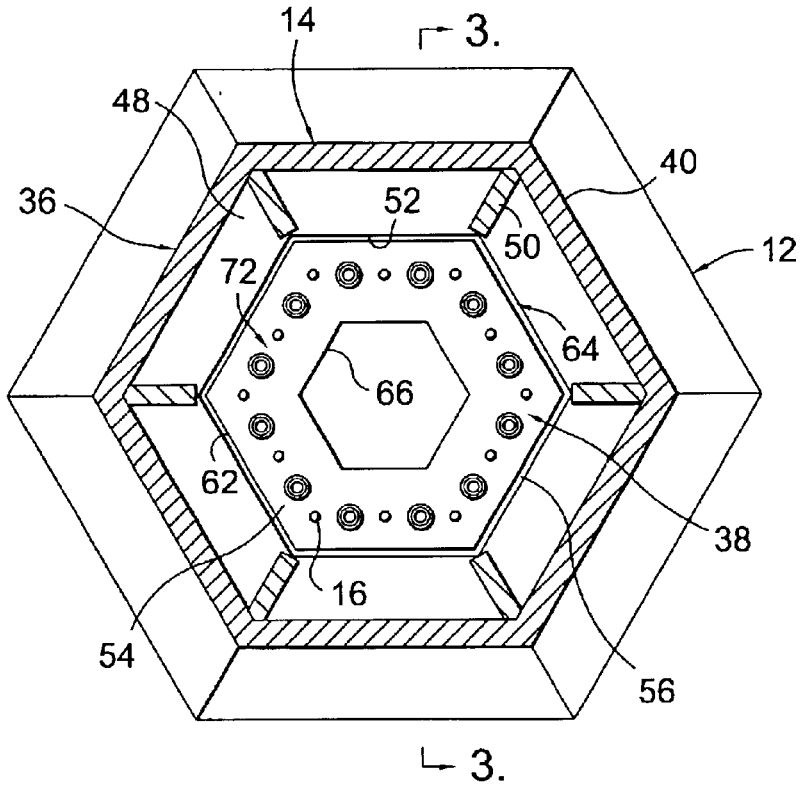
FIG. 2 is a cross-sectional view taken along line 2—2 of FIG. 1 showing a connector mounted to a pole segment.
Figure 6:
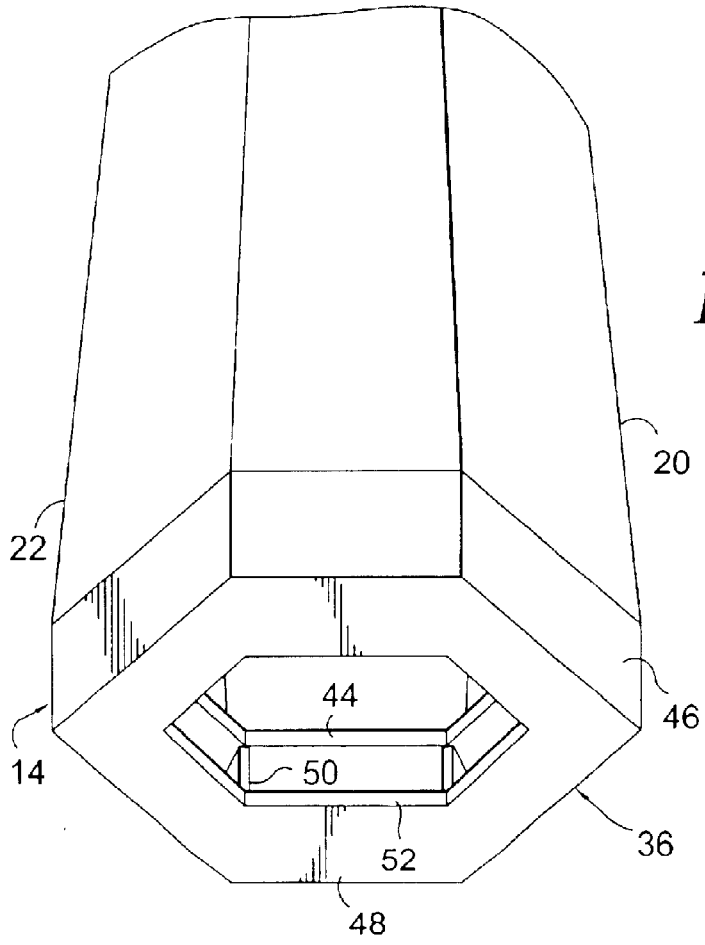
FIG. 6 is a perspective view showing an upper piece of the connector mounted to a pole segment.

As best seen in FIG. 1, connector 14 is used to couple two pole segments 12 to one another. As best seen in FIG. 4, connector 14 includes an upper piece 36 and a lower piece 38. Upper piece 36 includes a channel band 40 and a plurality of studs 42. Studs 42 are mounted within bottom portion 22 of pole segment 12. With additional reference to FIG. 6, channel band 40 includes top and bottom plates 44, 46, a cross piece 48 and a stiffener 50. Top plate 44 is fixedly coupled to studs 42 and extends inwardly towards cavity 18. Cross piece 48 extends downwardly from top plate 44 and is coupled to bottom plate 46. Bottom plate 46 extends inwardly and parallel with top plate 44. As best seen in FIGS. 2 and 6, bottom plate has a inner edge 52 that is adapted to interlock with lower piece 38. Although, inner edge 52 is in the shape of a hexagon, it should be understood that it may be formed in any shape that will allow it to interlock with lower piece 38. Stiffeners 50 extend between top and bottom plates 44, 46 and are used to stiffen channel band 40.

Figure 5:
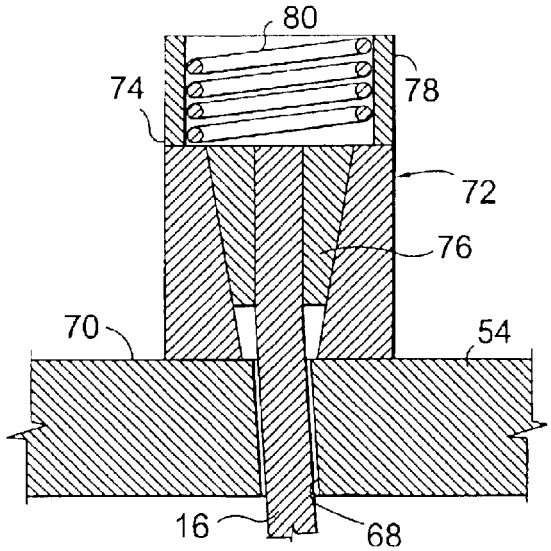
FIG. 5 is an enlarged view of the area encompassed by "5" in FIG. 4 showing an anchor coupled to a strand.

As best seen in FIGS. 2 and 4, lower piece 38 is mounted to top portion 24 of pole segment 12 and is used to interlock with upper piece 36. Lower piece 38 includes a cover plate 54, a base plate 56 and studs 58. Studs 58 are mounted within top portion 24 of pole segment and is fixedly mounted to base plate 56. Base plate 56 is a hexagonal ring and has a support surface 60. Cover plate 54 is also a hexagonal ring and mounted to a portion of a support surface 60 on base plate 56. Further, cover plate 54 includes an outer edge 62 adapted to interlock with inner edge 52 of channel band 40. Although outer edge 62 is shaped in the form of a hexagon, it should be understood and appreciated that outer edge 62 may be other shapes that will allow it to interlock with inner edge 52 of channel band 40. Outer edge 62 is sized so that there is a gap 64 between inner edge 52 and outer edge 62. However, gap 64 is small enough that the rotation between channel band 40 and cover plate 54 is minimized. Cover plate 54 also includes a rim 66 that may be aligned with rim 30 formed in top portion 24 of pole segment 12. Further, as best seen in FIG. 5, cover plate 54 has a plurality of holes 68 formed therein that are aligned with apertures 32 formed in thickened portion 28 so that strands 16 may pass therethrough. With reference to FIGS. 2 and 5, cover plate 54 also has a top surface 70 where one or more strand anchors 72 may be mounted thereon which will be described more fully below.

The post-tensioning of pole system 10 is accomplished through the use of a plurality of strands 16 that extend within hollow interior cavity 18, but which are external to the walls of pole segments 12. Strands 16 are adapted to be placed in tension so that pole segments 12 in pole system 10 are capable of withstanding an increased amount of tensile force. Strands 16 may be 0.5 inches (12 mm) in diameter and arranged within cavity 18 as shown in FIGS. 2 and 3. In particular, strands 16 may be arranged in repeats on each of the side of the hexagonal cross-section of pole segment 12 so the resulting radial symmetry provides relatively constant moments of inertia for flexural stiffness independent of lateral force direction. With specific reference to FIG. 4, strands 16 may extend through thickened portion 28 to ensure that strands 16 are positioned near inner surface 26 to allow them to make a maximum contribution to flexural stiffness. One strand 16 may extend from bottom portion 22 and be coupled to top end 22, 24 of the same pole segment 12. In addition, strand 16 may also extend from bottom portion 22 of a base pole segment 12 to a top portion 24 of a pole segment positioned on top of the base pole segment. Further, strands 16 may continue to extend to a pole segment further up the pole system 10.

As best seen in FIGS. 2 and 5, strands 16 are coupled to top portion 24 of pole segment 12 through the use of at least one anchor 72. Specifically, anchor 72 rests against top surface 70 of cover plate 54 and prevents strand 16 from being pulled downwardly towards bottom portion 22 of pole segment 12. Anchors 72 include a cylinder 74 having a clamping mechanism 76 slidably coupled within an interior portion of cylinder 74. Clamping mechanism 76 is a two-piece jaw structure having a variable diameter hole formed therein. The hole is tapered as it extends through the jaws and has one or more teeth or protrusions extending therein to grip and hold onto strand 16. Anchor 72 further includes a pipe 78 with a helical spring 80 fixedly mounted therein. Pipe 78 is fixedly mounted to the top ring of cylinder 74 and spring 80 is positioned to bias jaws 76 toward top surface 70 of cover plate 54.

In operation, pole system 10 may be a single pole segment 12 used alone, or in combination with one or more pole segments. A single or monopole system may extend to a height of 30 feet. Therefore, a system with four pole segments may extends to a height of 120 feet. Furthermore, a tripod system may extend to a height of approximately 240 feet. If one pole segment 12 is used by itself as the supporting structure, strands 16 are fed through hollow interior cavity 18 of pole segment and threaded through apertures 32 and holes 68 in cover plate 54 as best seen in FIGS. 3 and 4. Referring now to FIG. 5, a portion of each strand 16 that extends through holes 68 is coupled to anchor 72. In particular, strand 16 is pushed upwardly against jaws 76 to place the end portion of strand 16 within the hole formed between jaws 76. As strand 16 is being pushed upwardly,jaws 76 slide upwardly to compress spring 80. Spring 80 prevents the jaws 76 from being dislodged from cylinder 74. The angled portion of the jaws slides along an inner edge of cylinder 74 and the jaws splits apart. Once jaws 76 open enough to allow strand 16 to enter the inner diameter, the upward force on strands is release and spring 80 biased jaws 76 downwardly so that the hold formed between the jaws decreases and the teeth within the hole grips onto strand 16. The remaining strands 16 are coupled to top portion 24 of pole segment in a similar fashion. Strands 16 then proceed to extend downwardly to bottom portion 22 of pole segment 12. Bottom portion 22 of pole segment 12 is placed in a foundation hole and backfill such as compact fill, flowable concrete mix or reinforced concrete is added to the hole to support pole segment 12. Strands 16 are placed in tension by jacking or by other conventional methods to complete the post-tensioned pole system 10.

Two or more pole segments 12 may also be used to form pole system 10. Strands 16 are first fed through hollow interior cavity 18 of the bottom or base pole segment and external to the pole segment structure 12. Strands 16 are threaded through apertures 32 and holes 68 in cover plate 54. Some of strands 16 are then coupled to top surface 70 of cover plate 54 by anchors 72 as described in detail above. The remaining strands continue to extend through the hollow interior cavity 18 of the second pole segment. Bottom plate 48 is placed on support surface 60 and inner edge 52 is interlocked with outer edge 62 as best seen in FIGS. 2 and 4. Thus, the second pole segment is resting on top of the bottom or base pole segment. The remaining strands 16 are threaded through apertures 32 and holes 68 in cover plate 54 of the second pole segment.

All the remaining strands 16 may be coupled to cover plate 54 of the second pole segment by using strand anchors 72, or in the alternative, some strands 16 may be coupled to cover plate 54 while the remaining strands 16 continue to extend to a third pole segment. This process may continue in a similar fashion as described above until the desired height is achieved. For example, in a four pole system as shown in FIG. 1, thirty-six strands may extend within the cavity 18 of a bottom or base pole segment. At the juncture between the base segment and second segment, twelve of those strands may be mounted to cover plate on the base segment and twenty-four would continue to extend within cavity of the second pole segment. The juncture between the second and third pole segments is best shown in FIGS. 2 and 3. At this juncture, twelve of those strands may be mounted to cover plate 54 of the second pole segment and twelve would continue to extend within cavity 18 of the third pole segment. At the juncture between the third and fourth pole segments, six of those strands may be mounted to cover plate of the third pole segment and six would continue to extend within cavity of the fourth pole segment. Finally, the six remaining strands would then be coupled to the cover plate of the fourth pole segment. It will be understood that the joining of pole segments 12 and strands 16 may be conducted on the ground so the pole segments extend in a horizontal direction, or may be stacked on top of each other for vertical construction. Regardless of the number of strands in pole system 10, strands 16 in the multi-segmented construction are then placed in tension to create a post-tensioned pole system 10 and placed in the appropriate foundation as described above. In addition, concrete may then be poured through rims 30, 66 into hollow interior portion 18 in either the single or multi-pole segment structures to create a solid pole structure.

Figure 8:
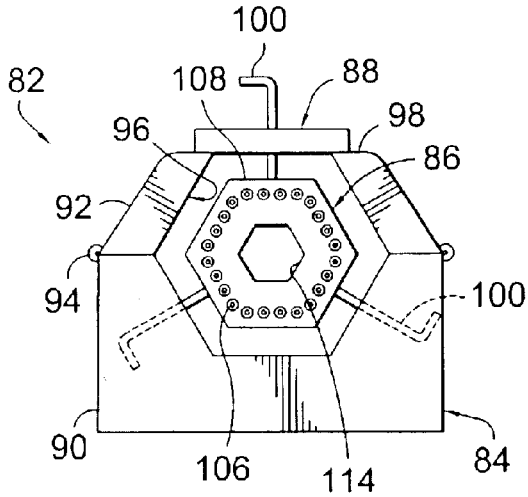
FIG. 8 is an elevational view of the external mold with an internal mold positioned therein.

The present invention further includes a mold unit 82 that may be used to precast pole segments 12 that are used in pole system 10 as best seen in FIG. 8. Mold unit 82 includes an external mold 84, internal mold 86 and a yoke 88. Mold unit 82 shown in the accompanying drawings is an example of a typical mold structure, and it will be understood that the proportions of the molds may vary depending on where the pole segment will be located in the pole system 10. For instance, a pole segment that will be positioned at the base or bottom of pole system will be much larger than a mold for a segment that will be positioned at the upper portions of pole system 10.

Figure 9:
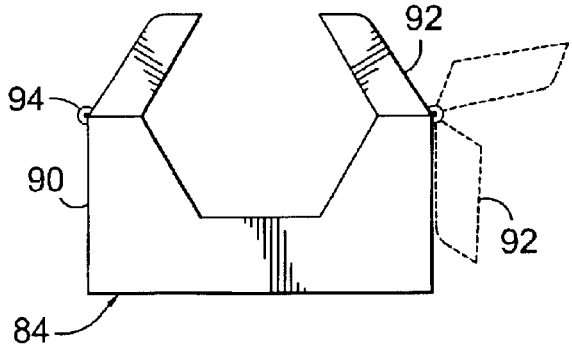
FIG. 9 is an elevational view of the external mold showing a top piece rotating about a hinge point as illustrated in dashed lines.
Figure 7:
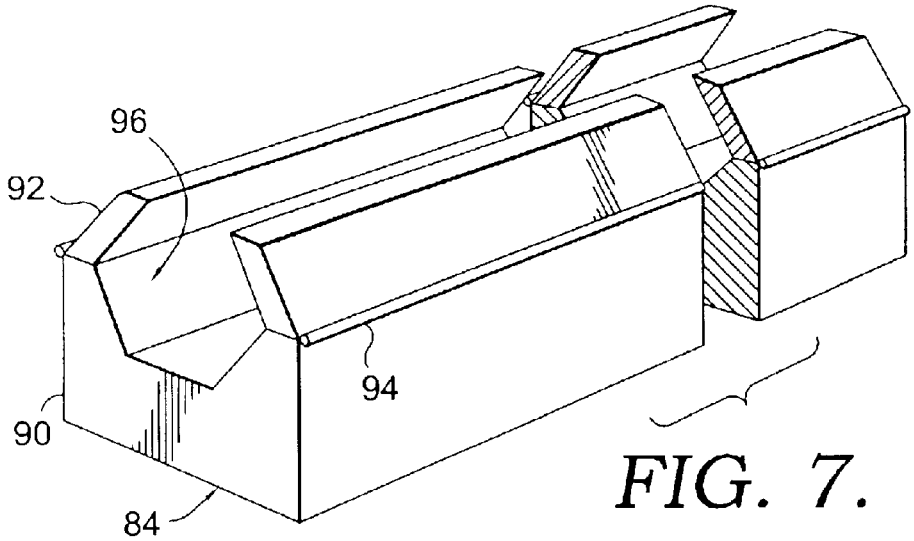
FIG. 7 is a perspective view of an external form used to form the external shape of a pole segment.

As best seen in FIG. 7, external mold 84 includes a bottom piece 90 and a pair of top pieces 92. In particular, top pieces 92 are coupled to bottom piece 90 by a set of hinges 94 which allow external mold 84 to be placed in closed and open positions. As best seen in FIG. 7, external mold 84 is in a closed position where bottom piece 90 and top pieces 92 are arranged to form a channel 96 which will define the outer surface 20 of pole segment 12. In addition, channel 96 may also taper inwardly along the longitudinal axis of external mold 84. As best seen in FIG. 9, top pieces 92 may be rotated outwardly about hinges 94 so that external mold 84 is in the open position so that pole segment 12 may be removed from external mold 84. As best seen in FIG. 8, external mold 84 also has a plurality of bolts 98 adjustably mounted within bottom piece 90. Bolts 98 are mounted within bottom piece 90 so that a portion of each bolt 98 can be independently adjusted to extend variable distances within channel 96 and contact internal mold 86. It is also within the scope of this invention to include bolts 98 in top pieces 92. Yoke 88 is removably coupled to a top surface 98 top pieces 92 and has a bolt 100 mounted thereto that is adapted to extend within channel 96 and contact internal mold 86. Yoke 88 is used to prevent top pieces 92 from floating or rotating relative to bottom piece 90 when the concrete is placed within mold unit 82.

Figure 10:
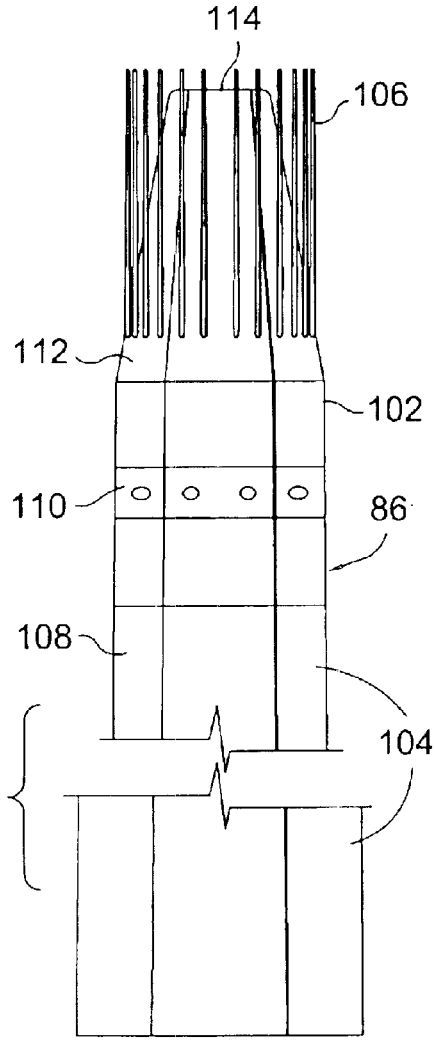
FIG. 10 is an elevational view of the internal mold having a tapered top piece.

As best seen in FIG. 10, internal mold 86 is tubular member having a top piece 102, a bottom piece 104 and a plurality of tubes 106. With additional reference to FIG. 8, bottom piece has an outer surface 108 that has a similar taper compared to channel 96, but is sized so there is a space between channel 96 and outer surface 108. Further, a collar 110 removably couples bottom piece 104 to top piece 102. An outer surface 112 of top piece 102 extends upwardly from collar 110 at the same taper as bottom piece 104 and then proceeds to narrow even further as it extends toward a rim 114. The increased taper towards the top portion of top piece 102 creates a larger space between channel 96 and outer surface 112 to allow for the formation of thickened portion 28 as seen in FIG. 4. Tubes 106 are used to form apertures 32 in thickened portion 28 of pole segment 12. In particular, tubes 106 are mounted to top piece 102 and extend outwardly therefrom in a direction parallel to the longitudinal axis of top and bottom pieces 102, 104. The distal ends of tubes 106 are tapered to make it easier to remove tubes with top and bottom pieces 102, 104 after the concrete hardens.

Figure 11:
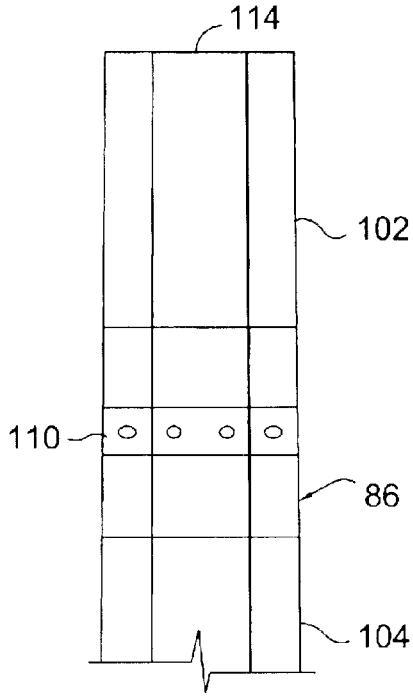
FIG. 11 is an elevational view of an internal mold similar to FIG. 10 having a non-tapered top piece.

As best seen in FIG. 11, top piece 102 may also have a uniform taper that is similar to bottom piece 104 as it extends from collar 110 to rim 114. To change top pieces 102, collar 110 is loosened, and the new top piece is slid onto bottom piece 104. Collar 110 is tightened and the change is complete. The uniform taper in top piece 102 results in a pole segment 12 with uniform wall thickness along its entire length. In this case, there would be no thickened portion 28 or apertures formed in pole segment 12 since strands 16 may pass through hollow interior cavity 18 without interfering with the walls of pole segment 12.

In forming a pole segment using mold unit 82, top pieces 92 on external mold 84 are rotated outwardly about hinges 94 to an open position. As best seen in FIG. 8, internal mold 86 is then placed within channel 96 and supported by bolts 100. Bolts 100 are adjusted in such a manner so that there is an equal amount of space between channel 96 and outer surfaces 108, 112 of internal mold 86. Top pieces 92 are then moved to the closed position. Yoke 88 is then placed on top surface 98 and is coupled to each top piece 92 to prevent top pieces 92 from rotating outwardly relative to bottom piece 90. Concrete is then poured between channel 96 and outer surfaces 108, 112. After the concrete cures, internal mold 86 is removed from the hardened pole segment 12 thereby forming hollow interior cavity 18 and apertures 32. Yoke 88 is then removed from top pieces 92 and top pieces 92 are moved to the open position. Pole segment 12 may them be removed from external mold 84 and used in pole system 10. It should be understood that pole segments may be formed either at an off-site location or a construction site.

It can, therefore, be seen that the invention is one that is designed to overcome the drawbacks and deficiencies existing in the prior art. The invention provides a pole system that includes one or more pole segments that are post-tensioned by strands that are positioned within a hollow interior cavity and external to the wall structure of the pole segments. The use of separate pole segments to form the pole system reduces the difficulty in transporting the components of the pole system. Each pole segment is relatively easy to maneuver and lift through the use of a crane, winch system, or helicopter to simplify installation. In addition, the fact that the strands are positioned within the hollow interior cavity of the pole segment reduces the amount of time it takes to manufacture the pole segments since each strand does not have to be positioned within the form prior to pouring the concrete in the form. Further, the connectors provided in the present invention simplify the process of coupling two pole segments to one another. Additionally, the forms of the present invention eliminates the need to purchase expensive spinning equipment for forming pole segments having a interior cavity.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A post-tensioned pole system for supporting a load, said system comprising:

first and second pole segments each having top and bottom ends, said first and second pole segments having a cavity formed therein;

a connector adapted to couple said top end of said first pole segment with said bottom end of said second pole segment;

a first strand coupled to first and second pole segments, said first strand extending within said cavity of said first and second pole segments, wherein said first strand is placed in tension so that said first and second pole segments are capable of withstanding forces imposed by the load and other external forces;

a second strand coupled with said first pole segment and said connector;

an anchor coupling said second strand to said connector, wherein said anchor includes:

a cylinder;

a clasping mechanism slidably received within said cylinder;

a pipe coupled to said cylinder; and a spring mounted in said pipe, wherein said clasping mechanism is releasably coupled to said second strand, and wherein said sprint retains said clasping mechanism within said cylinder.

2. The pole system of claim 1, wherein said first and second pole segments have a radially symmetric cross-section.

3. The pole system of claim 2, wherein said first and second pole segments have a hexagonal cross-section.

4. The pole system of claim 1, wherein said first and second pole segments are tapered.

5. The pole system of claim 1, wherein said top portion of said first pole segment includes a thickened portion.

6. The pole system of claim 5, wherein at least one aperture is formed in said thickened portion, and wherein said first strand extends through said aperture.

7. The pole system of claim 1, wherein at least one of first and second pole segments is approximately 30 feet in height.

8. A post-tensioned pole system for supporting a load, said system comprising:

first and second pole segments each having top and bottom ends, said first and second pole segments having a cavity formed therein;

a connector adapted to couple said top end of said first pole segment with said bottom end of said second role segment; wherein said connector includes an upper piece mounted to said second pole segment, and a lower piece mounted to said first pole segment; said upper piece including a channel band coupled to said second pole segment and a brace being disposed within said channel band;

a first strand coupled to first and second pole segments, said first strand extending within said cavity of said first and second pole segments, wherein said first strand is placed in tension so that said first and second pole segments are capable of withstanding forces imposed by the load and other external forces.

9. The pole system of claim 8, wherein said lower piece includes:

a base plate coupled to said first pole segment; and a cover plate coupled to said base plate and having an outer edge that is adapted to interlock with an inner edge of said upper piece.

10. A method for constructing a segmented post-tensioned pole system, said method comprising:

providing first and second pole segments each having top and bottom ends, said first and second pole segments having hollow interior portions;

providing a connector having upper and lower pieces, said upper piece being mounted to said bottom end of said second pole, and said lower piece being mounted to said top end of said first pole segment;

interlocking said upper and lower pieces of said connector;

providing a first strand;

coupling said first strand to said top end of said second pole segment;

extending said first strand within said hollow interior portions of said first and second pole segments;

placing said first strand in tension;

coupling said first strand to said bottom end of said first pole segment to form a post-tensioned the pole system;

providing for a second strand;

coupling said second strand to said connector by an anchor;

extending said second strand in said hollow interior portion of said first pole segment;

placing said second strand in tension; and coupling said second strand to said bottom end of said first pole segment;

wherein said ton end of said first pole segment includes a thickened portion, and wherein said second strand extends through said thickened portion.

11. The method of claim 10, wherein said top end of said first pole segment includes a thickened portion, and wherein said first strand extends through said thickened portion.

* * * * *